US005547794A

United States Patent [19]

Demizu et al.

[11] Patent Number: 5,547,794

[45] Date of Patent: Aug. 20, 1996

[54] TONER FOR ELECTROSTATIC LATENT IMAGE DEVELOPING

[75] Inventors: Ichiro Demizu, Toyonaka; Yasuki Nagai, Amagasaki; Mitsutoshi Nakamura, Ibaraki; Yukio Tanigami, Amagasaki; Hideaki Ueda, Kishiwada, all of Japan

[73] Assignee: Minolta Co., Ltd., Osaka, Japan

[21] Appl. No.: 448,998

[22] Filed: May 24, 1995

[30] Foreign Application Priority Data

May 31, 1994 [JP] Japan ..... 6-118522

[51] Int. Cl.[6] ..... G03G 9/087

[52] U.S. Cl. ..... 430/106

[58] Field of Search ..... 430/106, 137

[56] References Cited

U.S. PATENT DOCUMENTS

| | | | |
|---|---|---|---|
| 4,996,126 | 2/1991 | Anno et al. | 430/106.6 |
| 5,023,158 | 6/1991 | Tomono et al. | 430/99 |
| 5,219,694 | 6/1993 | Anno et al. | 430/106.6 |
| 5,346,790 | 9/1994 | Sacripante et al. | 430/137 |
| 5,415,964 | 5/1995 | Hayashi et al. | 430/137 |
| 5,444,140 | 8/1995 | Paine et al. | 430/137 |

FOREIGN PATENT DOCUMENTS

| | | |
|---|---|---|
| 38-2095 | 3/1981 | Japan . |

*Primary Examiner*—John Goodrow
*Attorney, Agent, or Firm*—McDermott, Will & Emery

[57] ABSTRACT

A toner for electrostatic latent image developing containing at least a binder resin, a coloring agent and a charge controller that are dissolved or dispersed in a non-water soluble organic solvent to form an emulsion dispersion of a colored resin solution in aqueous dispersion. The toner of the present invention is produced by forming the emulsion dispersion of a colored resin solution in aqueous dispersion followed by removal of the non-water soluble organic solvent and water to obtain a toner having a residual organic solvent content of about 5 to about 100 ppm and a residual moisture content of about 0.05 to about 1.0 percent-by-weight of total toner weight.

15 Claims, No Drawings

TONER FOR ELECTROSTATIC LATENT IMAGE DEVELOPING

BACKGROUND OF THE INVENTION

1. Field of the Invention

The present invention relates to toner for electrostatic latent image developing. In particular, the present invention relates to an electrostatic latent image-developing toner to be used for developing electrostatic latent images in electrophotography, electrostatic recording, electrostatic printing and the like.

2. Description of the Prior Art

Heretofore, the production of toner for use in electrophotography, electrostatic recording, electrostatic printing, and the like included the use of pulverization, suspension polymerization, and emulsion dispersion methods. According to the pulverization method, toner constituents, such as a resin, a pigment and a charge controlling agent, are mechanically kneaded and then pulverized to obtain a toner. The suspension polymerization method is used to manufacture toner by suspending a monomer, a polymerization initiator, a coloring agent and other additives in a dispersion medium, and then heating the dispersion medium to polymerize the monomer and form a resin. According to the emulsion dispersion method, an emulsion through emulsion dispersion is formed in an aqueous dispersion of a colored resin solution. The colored resin solution is prepared by dissolving a resin, a coloring agent and a charge controlling agent in a non-water soluble organic solvent. The emulsion is then simultaneously heated and stirred to evaporate the organic solvent and to precipitate fine resin particles of toner.

Of the above methods, the emulsion dispersion method is the simplest for obtaining fine resin particles averaging about 1 to 10 μm in size. By using the emulsion dispersion method, greater production efficiency and lower costs are realized compared to the pulverization and suspension polymerization methods. Further, many different types of resins can be used in the emulsion dispersion method in comparison to the limited number that can be used in the suspension polymerization method. However, toner obtained by the emulsion dispersion method exhibits unstable charge performance characteristics because it is are easily affected by ambient environmental conditions, such as temperature and humidity. In addition, such toner undesirably tends to agglomerate or flocculate when stored in high-temperature environments.

After extensive research, the present inventors have discovered that trace amounts of residual organic solvent and moisture content in a toner disadvantageously affect charge performance and heat resistance characteristics of the toner. In particular, when producing toner by the emulsion dispersion method, the aqueous dispersion containing a colored resin solution is heated to evaporate and remove the organic solvent. The moisture content on the surface and interior of the resultant fine colored resin particles is conventionally eliminated by washing and by drying in a drying device. In essence, the organic solvent and moisture content are evaporated by exposing the resin particles to temperatures that are higher than the boiling point of the organic solvent and moisture content contained in the resin particles. Despite these measures, however, problems persist in that residual organic solvent and moisture content are often not adequately removed thereby resulting in trace amounts of residual organic solvent and moisture content still remaining on or near the surface of the toner. In addition, charge performance of such a toner can significantly deteriorate when it is stored in a high-temperature/high-humidity environment. Further, excess residual organic solvent content and moisture content can affect toner performance by causing particles of the toner to flocculate or agglomerate undesirably when stored at high temperatures for prolonged periods of time.

SUMMARY OF THE INVENTION

In view of the above drawbacks, an object of the present invention is to provide an electrostatic latent image developing toner that exhibits stable charge performance, that remains unaffected by ambient environmental conditions, that possesses excellent heat resistance properties and that does not undesirably flocculate or agglomerate when stored at high temperatures for prolonged periods of time. Through extensive research, the present inventors have been able to reduce the amount of residual organic solvent content and moisture content in toner to a prescribed range that overcomes the above drawbacks. As a result, the present inventors have been able to reduce ambient fluctuations in charge amount, to increase the heat resistance characteristics and to substantially eliminate the occurrence of toner agglomeration or flocculation in a toner when stored at high temperatures for prolonged periods of time.

In particular, the above drawbacks are overcome by the present invention, which provides toner comprising a residual organic solvent content of about 5 to about 100 ppm and a residual moisture content of about 0.05 to about 1.0 percent-by-weight of total toner weight, said toner being produced by an emulsion dispersion method comprising:

preparing an emulsion dispersion comprising water and a non-water-soluble component, said non-water-soluble component comprising a binder resin and an organic solvent; and removing the water and the organic solvent to form particles of said toner having said organic solvent and residual moisture contents.

DETAILED DESCRIPTION OF THE PREFERRED EMBODIMENTS

To achieve the above objects, the present invention provides a toner for electrostatic latent image developing comprising at least (a) a binder resin comprising a suitable polymer, such as, but not limited to, styrene polymer, polyester polymer, epoxy polymer, etc., and (b) a coloring agent to form an emulsion of colored resin solution by an organic solvent in aqueous dispersion. Further, the present invention's toner further comprising (c) a charge controlling agent that is dissolvable or dispersable in a non-water soluble organic solvent. The toner of the present invention is produced by the emulsion dispersion method by preparing an emulsion dispersion of a colored resin solution in aqueous dispersion followed by removal of the non-water soluble organic solvent and moisture content such that the amount of residual organic solvent content in the toner is about 5 to about 100 ppm and the amount of residual moisture content in the toner is about 0.05 to about 1.0 pbw.

According to the present invention, a colored resin solution is obtained by dispersing a binder resin, a coloring agent, and a charge controlling agent in an aqueous dispersion. A magnetic powder and an offset inhibitor may be used if a non-water soluble organic solvent is employed. The resulting colored resin solution is emulsion-dispersed in aqueous dispersion to form an oil-in-water (O/W) type emulsion, after which the non-water soluble organic solvent is removed from the O/W emulsion to obtain granular toner resin particles. (O/W emulsion denotes a suspension in which an oily liquid forms droplets that are dispersed in aqueous dispersion.) The resulting toner resin particles are washed, dried and sorted, as required, to form a toner having a preferred average particle diameter of about 2 to about 15 μm, more preferably about 4 to about 10 μm.

The preferred amount of residual organic solvent content in toner of the present invention is about 5 to about 100 ppm, more preferably about 5 to about 50 ppm. If the amount of residual organic solvent content exceeds about 100 ppm, then the present inventors have discovered that ambient fluctuations in the amount of charge become great; an adequate amount of charge cannot be obtained; heat resistance characteristics deteriorate; and the occurrence of toner scattering increases. On the other hand, manufacturing costs become intolerable when the amount of residual organic solvent content is under about 5 ppm.

The preferred amount of residual moisture content in toner of the present invention is about 0.05 to about 1.0 pbw, more preferably about 0.05 to about 0.5 pbw. Ambient fluctuations in the amount of charge become great and the heat resistance characteristics deteriorate when the residual moisture content exceeds about 1.0 pbw. In addition, an adequate amount of charge is not obtained and scattering of toner increases when the residual moisture content exceeds about 1.0 pbw. On the other hand, manufacturing costs become intolerable when the moisture content is under about 0.05 pbw. According to the present invention, non-water soluble organic solvent is removed from the O/W emulsion and the temperature and pressure are adjusted in conjunction with the boiling point of the organic solvent that is used to set the amount of residual organic solvent content ultimately obtained in the toner. Moreover, adequate processing time is allowed and sufficient temperatures are used to ensure this result. For example, where toluene is employed as the organic solvent, the material should be stored for no less than 5 hours, preferably no less than 6 hours; at a temperature of no less than 58° C., preferably no less than 60° C.; and at a pressure of no more than 140 mmHg, preferably no more than 100 mmHg.

According to the present invention, the decompression and heating step in the emulsion dispersion method is very important for obtaining the preferred ranges of residual organic solvent content and moisture content. A drying device such as a medium fluid dryer MSD200 (Nara Machine Works, Ltd.) may be used to dry the fine colored resin particles obtained by the emulsion dispersion method and to set the residual moisture content of toner according to the present invention. For example, the hot-air temperature should be set at no less than about 100° C., preferably no less than about 105° C. Processing of about 1 to about 10 kg/hr should be carried out for no less than about 10 minutes when the drying device MSD200 is used at its lowest setting.

Further, any suitable binder resin can be employed in the toner of the present invention so long as the binder resin is soluble in a non-water soluble organic solvent and insoluble or has low solubility in water. Examples of polymers that may be used alone or in any combination as binder resins in the present invention include, but are not limited to, various types of known resins such as styrene resin, (meth)acrylic resin, styrene-(meth) acrylic copolymer resin, olefin resin, polyester resin, polyamide resin, polycarbonate resin, polyether resin, polyvinyl acetate resin, polysulfonate resin, epoxy resin, polyurethane resin and urea resin.

In addition, according to the present invention, the binder resin should preferably have a glass transition temperature (Tg) of about 50° C. to about 70° C., a numerical average molecular weight (Mn) of about 1000 to about 50,000, preferably about 3000 to about 20,000, and a molecular weight distribution ratio of about 2 to about 60 (weight average molecular weight (Mw):Mn (Mw/Mn)). The present inventors have discovered that the heat resistance characteristics of the resultant toner declines if Tg is set below about 50 ° C. On the other hand, fixation properties of a toner decline when Tg exceeds about 70° C.

Further, high-temperature offset readily occurs when the average molecular weight (Mn) is under about 1000, while low-temperature offset readily occurs when MN exceeds about 50,000. In addition, the non-offset range becomes narrow when Mw/Mn falls below 2, while low-temperature offset tends to readily occur when Mw/Mn exceeds about 60.

According to the present invention, Mw/Mn should preferably be about 2 to about 6 when the toner of the present invention is used for an oil-based fixation, while Mw/Mn should preferably be about 20 to about 50 when the toner of the present invention is used for an oil-less fixation.

According to the present invention, any suitable organic solvent may be used for dissolving the binder resin so long as it is insoluble or has low solubility in water. Examples of suitable organic solvents that may be used alone or in any combination according to the present invention include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Preferred organic solvents include, but are not limited to, aromatic solvents such as toluene and xylene, and halogenated hydrocarbons such as methylene chloride, 1,2-dichloroethane, chloroform and carbon tetrachloride.

Various types of organic and inorganic pigments of varying colors can be used as coloring agents in the present invention. For instance, preferred black pigments include, but are not limited to carbon black, copper oxide, manganese dioxide, aniline black, active carbon, non-magnetic ferrite, magnetic ferrite magnetite and the like.

Preferred yellow pigments include, but are not limited to, chrome yellow, zinc yellow, cadmium yellow, yellow iron oxide, mineral fast yellow, nickel titanium yellow, naval yellow, naphthol yellow S, Hanzai yellow G, Hanzai yellow 10G, benzidine yellow G, benzidine yellow GR, chinoline yellow lake, permanent yellow NCG, tartrazine lake and the like.

Preferred orange pigments include, but are not limited to, red zinc, molybdenum orange, permanent orange GTR, pyrazolone orange, vulcan orange, indanthrene brilliant orange RK, benzidine orange G, indanthrene brilliant orange GK and the like.

Preferred red pigments include, but are not limited to, red iron oxide, cadmium red, red lead, mercury sulfide, cadmium, permanent red 4R, resol red, pyrazolone red, watching red, calcium salts, lake red C, lake red D, brilliant carmine 6B, eosin lake, rhodamine lake B, alizarin lake, brilliant carmine 3B and the like.

Preferred violet pigments include, but are not limited to, manganese violet, fast violet B, methyl violet lake and the like.

Preferred blue pigments include, but are not limited to, prussian blue, cobalt blue, alkali blue lake, victoria blue lake, phthalocyanine blue, inorganic phthalocyanine blue, phthalocyanine blue partial chloride, fast sky blue indanthrene blue BC and the like.

Preferred green pigments include, but are not limited to, chrome green, chromium oxide, pigment green B, malachite green lake, final yellow green G and the like.

Preferred white pigments include, but are not limited to, zinc white, titanium oxide, antimony white zinc sulfide and the like.

Preferred extender pigments that may be used in toner of the present invention include, but are not limited to, pearlite powder, barium carbonate, clay, silica, white carbon, talc, alumina white and the like.

The above coloring agents may be used alone or in any combination, as desired.

According to the present invention, the preferred amount of coloring agent that should be used is about 1 to about 20 parts-by-weight, more preferably about 2 to about 15 parts-by-weight, per 100 parts-by-weight of binder resin contained in the toner. The present inventors have found that toner fixation declines when the amount of coloring agent exceeds about 20 parts-by-weight, while an undesirable image consistency is obtained when the amount of coloring agent falls below about 1 part-by-weight.

Optionally, a charge controlling agent, a magnetic powder and/or an offset inhibitor may be blended with the binder resin and coloring agent to obtain a toner of the present invention, as desired. Various types of charge controlling agents that can provide a positive or negative charge through friction charging are known and can be used. For instance, preferred positive charge controlling agents include, but are not limited to, nigrosine dyes, such as nigrosine base EX (Orient Chemical Industries, Ltd.), quaternary ammonium salts, such as quaternary ammonium salt P-51 (Orient Chemical Industries, Ltd.), copy charge PX VP435 (Hoechst, Inc.), and intidazole compounds, such as alkoxylated amine, alkylamide, molybdate chelate pigment, and PLZ1001 (Shikoku Chemical Industry Co., Ltd.).

Preferred negative charge controlling agents include, but are not limited to, metal complexes, such as Pontton S- 22 (Orient Chemical Industries, Ltd.), Pontron S-34 (Orient Chemical Industries, Ltd.), Pontron E-81 (Orient Chemical Industries, Ltd.), Pontton E-84 (Orient Chemical Industries, Ltd.), spiron black TRH (Hodogaya Chemical Industries, Ltd.), quaternary ammonium salts, such as thioindigo pigment, copy charge NX VP434 (Hoechst, Inc.), calyx allene compounds, such as Pontron E-89 (Orient Chemical Industries, Ltd.), and fluorine compounds, such as magnesium fluoride and carbon fluoride.

Metal complexes that can form suitable negative charge controllers may be used in the toner of the present invention in addition to those listed above. Preferred metal complexes include, but are not limited to, oxycarboxylic acid metal complexes, dicarboxylic acid metal complexes, amino acid metal complexes, diketone metal complexes, diamine metal complexes, benzene containing azo radicals-benzene derivative structural metal complexes, and benzene containing azo radicals-naphthalene derivative structural metal complexes.

According to the present invention, the amount of charge controlling agent that is added should be about 0.1 to about about 5 parts per 100 parts-by-weight of binder resin contained in the toner, preferably about 0.1 to about 3 parts-by-weight.

Preferred examples of magnetic powder that may be used in the toner of the present invention include, but are not limited to, magnetite, -hematite, various types of ferrite and the like.

Preferred offset inhibitors that may be used in the toner of the present invention include, but are not limited to, various types of wax, especially low molecular weight polypropylene, polyethylene, as well as polyolefin wax including oxide type polypropylene and polyethylene.

Common devices that may be used for dissolving and dispersing toner constituents in non-water soluble organic solvents are known. Examples of such devices that may be used according to the present invention include, but are not limited to, a ball mill, a sand grinder, and a ultrasonic homogenizer.

According to the present invention, the solid-fraction concentration in resin solution containing a coloring agent must be set such that liquid droplets readily solidify as particles following removal of non-water soluble organic solvent by heating the O/W emulsion. The solid-fraction concentration is preferably about 5 to about 50 pbw, more preferably about 10 to about 40 pbw.

Any suitable method for adequately stirring a mixed system comprising resin solution containing coloring agent and aqueous dispersion may also be employed. For instance, a stirring device such as a homomixer can be used to form an O/W emulsion. However, according to the present invention, stirring time should be no less than about 10 minutes because a preferred particle size distribution can not be obtained if stirring time is shorter.

In addition, according to the present invention, the ratio of volume (Vp) of colored resin solution to volume (Vw) of aqueous dispersion should preferably fall in a range of $Vp/Vw \leqq$ about 1, more preferably about $0.3 \leqq Vp/Vw >$ about 0.7. However, a stable O/W emulsion cannot be formed if $Vp/Vw > 1$ because either phase transition readily occurs, or a W/O emulsion tends to forms.

Further, preferred aqueous dispersions that can be used to form an O/W emulsion include, but are not limited to, water or dispersions in water containing a water-soluble organic solvent. Specific examples that may be used include, but are not limited to, water/methanol mixed solution (weight ratio 50/50 to 100/0), water/ethanol mixed solution (weight ratio 50/50 to 100/0), water/acetone mixed solution (weight ratio 50/50 to 100/0), water/methyl ethyl ketone mixed solution (weight-ratio 70/30 to 100/0), and the like.

According to the present invention, dispersion stabilizers and dispersion stabilizer auxiliary agents may be added to the aqueous dispersion, as desired. Dispersion stabilizers contain hydrophilic colloids in aqueous dispersion. Examples of dispersion stabilizers that may be used in the manufacture of toner of the present invention include, but are not limited to, gelatin, acacia, agar, cellulose derivatives including hydroxymethyl cellulose, hydroxyethyl cellulose, and hydroxypropyl cellulose, and synthetic macromolecules including, but not limited to, polyvinyl alcohol, polyvinyl pyrrolidone, polyacrylamide, polyacrylate, polymethacrylate and the like.

In addition, easily cleaned irregular resin particles can be obtained when calcium phosphates are used as the dispersion stabilizer. The present inventors have discovered that calcium phosphates having low solubility in water may be used to enhance such cleaning properties. Preferred calcium phosphates include, but are not limited to, tricalcium phosphate, calcium diphosphate, hydroxycalcium phosphate and the like. These preferred calcium phosphates may adopt the form of a double salt with calcium fluoride and calcium chloride. Thus, when calcium phosphates are used as a dispersion stabilizer, they can be easily removed from the fine particles by washing with water following dissolution of calcium phosphates using acids, such as hydrochloric acid, before drying the fine particles.

Examples of dispersion stabilizer auxiliary agents that can be used according to the present invention include, but are not limited to, natural surfactants, such as saponin, nonionic surfactants, such as alkylene oxide, glycerol, glycidol, and anionic surfactants containing acidic radicals, such as carboxylic acid, sulfonic acid, phosphoric acid, sulfate ester radicals and phosphate ester radicals. In particular, anionic surfactants, such as dodecyl benzene sodium sulfonate or sodium lauryl sulfate, are preferred when calcium phosphates are used as the dispersion stabilizer. On the other hand, anionic surfactants are preferred when polyvinyl alcohol is used as dispersion stabilizer.

The present invention will be further exemplified below through the following, non-limiting examples. All parts presented below are based on weight.

EXAMPLE 1

Polyester resin (95° C. softening point, 65° C. Tg, Mn=3500, Mw/Mn=2.5) (100 parts), copper phthalocyanine blue pigment (Toyo Ink Co., Ltd.) (6 parts) and a charge controlling agent (Bontron E-84 (Orient Chemical Industries, Ltd.)) (2 parts) are processed for 30 minutes using an ultrasonic homogenizer (400 μA output), and colored resin solution is prepared by dissolving/dispersing in 400 parts of toluene.

Sodium lauryl sulfate (Wako Pure Chemical Industries, Ltd.) (0.1 part) is dissolved in 1000 parts of 4 pbw hydroxycalcium phosphate as a dispersion stabilizer in the preparation of aqueous dispersion.

The colored resin solution (50 parts) is slowly added to the aqueous dispersion (100 parts) with stirring at 4000 rpm using a TK homomixer (product Tokushu Kika Industries, Ltd.). A suspension of liquid droplets with average particle diameter of 6 μm is prepared and stored for 5 hours at 60° C., 140 mmHg to remove toluene, followed by dissolution of calcium phosphate using concentrated hydrochloric acid. Filtration/water washing is repeated thereafter, followed by particle drying for 30 minutes at a hot-air temperature of 105° C., processing volume of 5 kg/hr using a drying device (medium fluid dryer MSD200 (Nara Machine Works, Ltd.)) to provide toner 1 having an average particle diameter of 6.0 μm.

EXAMPLE 2

A suspension of colored resin solution in aqueous dispersion is prepared by the same procedures as those used in Example 1 except for the use of a polyester resin (98° C. softening point, 68° C. Tg, Mn=4500, Mw/Mn=3.1) as the binder resin. Next, toner 2 having an average particle diameter of 6.2 μm is obtained using the same procedures used in Example 1 except for the alteration of the drying conditions to 105° C., 3 kg/hr following removal of toluene by storage for 8 hours at 65° C., 100 mmHg.

EXAMPLE 3

A suspension of colored resin solution in aqueous dispersion is prepared by the same procedures used in Example 1 except for the use of a polyester resin (92° C. softening point, 63° C. Tg, Mn=3200, Mw/Mn=2.1) as the binder resin. Next, toner 3 having an average particle diameter of 5.8 μm is obtained using the same procedures used in Example 1 except for the alteration of the drying conditions to 110° C., 5 kg/hr following removal of toluene by storage for 10 hours at 65° C., 70 mmHg.

EXAMPLE 4

Toner 4 having an average particle diameter of 6.2 μm is obtained using the same procedures in Example 1 except for the alteration of the drying conditions to 10° C., 5 kg/hr following removal of toluene by storage for 10 hours at 65° C., 70 mmHg.

EXAMPLE 5

Toner 5 having an average particle diameter of 6.2 μm is obtained using the same procedures in Example 1 except for alteration of the drying conditions to 110 ° C., 1 kg/hr following removal of toluene by storage for 10 hours at 65° C., 80 mmHg.

COMPARATIVE EXAMPLE 1

A suspension of colored resin solution in aqueous dispersion is prepared by the same procedures used in Example 1 except for the use of a polyester resin (94° C. softening point, 65° C. Tg, Mn=3400, Mw/Mn=2.3) as the binder resin. Next, toner 6 having an average particle diameter of 6.1 μm is obtained using the same procedures used in Example 1 except for alteration of the drying conditions to 90° C., 3 kg/hr following removal of toluene by storage for 8 hours at 55° C., 100 mmHg.

COMPARATIVE EXAMPLE 2

Toner 7 having an average particle diameter of 6.1 μm is obtained using the same procedures used in Reference Example 1 except for the alteration of the drying conditions to 100° C., 3 kg/hr following removal of toluene by storage for 10 hours at 55° C., 100 mmHg.

COMPARATIVE EXAMPLE 3

Toner 8 having an average particle diameter of 6.1 μm is obtained using the same procedures used in Reference Example 1 except for the alteration of the drying conditions to 90° C., 5 kg/hr following removal of toluene by storage for 5 hours at 60° C., 100 mmHg.

DETAILS OF CARRIER PRODUCTION

For each of the above examples, a resin coated carrier is made according to the following procedure. Styrene-acrylic resin solution having a solid fraction proportion of 2 pbw is prepared by diluting a styrene-acrylic copolymer (80 parts) comprising styrene, methyl methacrylate, 2-hydroxyethyl acrylate and methacrylic acid (a ratio of polymerizing factors: 1.5:7:1.0:0.5) and butylated melamine resin (20 parts) with toluene. Using a spiracoater (Okada Seiko K.K.), the styrene-acrylic resin solution is then applied to a core of calcined ferrite powder F-300: average particle diameter 50 μm, bulk density 2.53 g/cm$^3$ (Powdertech Inc.), and dried. The resulting carrier is calcined by setting it in a hot-air circulating oven at 140° C. for 2 hours. After cooling, bulk ferrite powder is disintegrated using a sieve fitted with a screen mesh of 210 μm by 90 μm, to obtain a resin-coated ferrite powder. The resin coated ferrite powder is subjected three times each to the coating, calcination and disintegration steps in order to produce a resin coated carrier. The average particle diameter of the carrier obtained is 52 μm and the electrical resistance is approximately $3\times10^{10}\Omega$cm.

EVALUATION PROCEDURES

The various characteristics of the above toners are evaluated and compared according to the following procedures.

(1) MEASUREMENT OF AMOUNT OF RESIDUAL SOLVENT

The amount of residual organic solvent content in each toner is measured by the internal standard method using gas chromatography.

(2) MEASUREMENT OF RESIDUAL MOISTURE CONTENT

The moisture content of toner following storage for 2 hours at 25° C., 60 % humidity, is measured using a Karl Fischer moisture meter (KC-3P: Kyoto Electronic Industries, Ltd.).

(3) HEAT RESISTANCE

The degree of toner flocculation following storage for 24 hours at 50° C. of toner (5 g) which had been cast into a 50 cc glass bottle is visually observed and evaluated based on the following ranking standards.

o: No flocculation of toner developed.

Δ: Some flocculation of toner developed, but it broke up upon shaking of the bottle so as to pose no practical problem.

X: All of the toner flocculated, and the flocculation did not break up even after shaking, which made it useless in practice.

(4) MEASUREMENT OF AMOUNT OF CHARGE

Both 0.3 part of silica (H-2000: Walker Inc.) and 0.5 part of hydrophobic titanium oxide (T-805: Nihon Aerogel Ltd.) are added to 100 parts of toner produced in the above examples, followed by treatment for 1 minute at 1000 rpm using a Henschel mixer (Sani Sanchi Kakoki Ltd.). Developer for evaluation is then prepared by mixing post-treated toner in a 5 pbw proportion in the carrier.

Developer (30 g) is cast into a 50 cc volume polyethylene bottle and rotated for 90 minutes at 1200 rpm to bring it into contact with film which had been charged so as to have a prescribed potential. The amount of charge of the toner is determined by measuring the weight of toner adhering to the film. The measurements are carried out in a normal-temperature normal-humidity environment (25° C., 60% humidity).

(5) EVALUATION OF AMBIENT FLUCTUATION OF AMOUNT OF CHARGE

The amount of charge ($Q_{LL}$) Of developer is prepared using the same procedures in measuring the amount of charge and then agitated, followed by storage for 24 hours at 10° C., 15% humidity. The amount of charge ($Q_{HH}$) of developer that had been stored for 24 hours at 30° C., 85% humidity is measured, and the difference ΔQ determined. Specifically, $\Delta Q=Q_{LL}-Q_{HH}$. The ambient fluctuation in the amount of charge is evaluated by the following ranking standards. o and Δ represent pass and fail, respectively. The amount of charge is measured at normal temperature and normal humidity (25° C., 60% humidity).

o: $\Delta Q<10$[micro-c/g]

Δ: $10\leqq\Delta Q\leqq 15$[micro-C/g]

X: $\Delta Q>15$[micro-C/g]

(6) MEASUREMENT OF THE AMOUNT OF TONER WITH POOR CHARGE

Developer (3 g) is prepared by the same procedures used for measuring the amount of charge, and then agitated. The developer is laid on a magnetic roll of 310 mm diameter. An opposing electrode, which had been precisely weighed is then set. Bias voltage of 1 kV with opposite polarity from that of the toner is applied, and the magnetic roller is rotated for 1 minute at 1000 rpm. The opposing electrode is then carefully reweighed, and the difference from the initial value is taken to compute the amount of liberated toner that adhered to the opposing electrode, specifically, the weight of toner with poor charge. In this manner, the proportion of the weight of toner with poor charge to the total toner weight, which had been supplied for measurement, could be taken as the weight of toner having poor charge characteristics.

TABLE 1 shows the results of above measurements.

TABLE 1

| | Amount residual organic solvent (ppm) | Residual moisture content (wt. %) | Amount of charge (μC/g) | Ambient fluctuation of charge amount | Heat resistance |
|---|---|---|---|---|---|
| Example 1 | 100 | 0.6 | 33 | Δ | Δ |
| Example 2 | 50 | 0.5 | 35 | ○ | ○ |
| Example 3 | 5 | 0.4 | 36 | ○ | ○ |
| Example 4 | 50 | 0.9 | 33 | Δ | Δ |
| Example 5 | 50 | 0.05 | 35 | ○ | ○ |
| Comparative Example 1 | 180 | 1.3 | 28 | X | X |
| Comparative Example 2 | 200 | 0.7 | 29 | X | X |
| Comparative Example 3 | 80 | 1.5 | 29 | X | X |

Table 1 shows that Examples 1–5 possess 5 to 100 ppm residual organic solvent content and 0.05 to 1.0 pbw residual moisture content. Table 1 further shows that Examples 1–5 possess an adequate amount of charge and suffer no practical problems in terms of ambient fluctuation in the amount of charge or heat resistance. In contrast, Table 1 shows that the amount of residual organic solvent content and, the residual moisture content in the Comparative Examples were outside the ranges exhibited by the Examples 1–5. Moreover, the amount of charge is lower than that of Examples 1–5, and problems involving the amount of charge and the ambient fluctuation are observed.

Thus, in view of the above, the present inventors have achieved a toner that has a small particle size, that is capable of obtaining and maintaining an adequate amount of charge without an unacceptable amount of ambient fluctuation in the amount of charge, and that has outstanding heat resistance characteristics.

While the invention has been described with reference to particular preferred embodiments, it is understood that other embodiments and modifications can be made by those of ordinary skill in the art without departing from the spirit and scope of the present invention.

What is claimed is:

1. A toner comprising a residual organic solvent content of about 5 to about 100 ppm and a residual moisture content of about 0.05 to about 1.0 percent-by-weight of total toner weight, said toner being produced by an emulsion dispersion method comprising:

preparing an emulsion dispersion comprising water and a non-water-soluble component, said non-water-soluble component comprising a binder resin and an organic solvent; and removing the water and the organic solvent to form particles of said toner.

2. The toner of claim 1, wherein the residual organic solvent content is about 5 to about 50 ppm and the residual moisture content is about 0.05 to about 0.5 percent-by-weight of total toner weight.

3. The toner of claim 1, wherein said toner has an average particle diameter of about 2 to about 15 μm.

4. The toner of claim 1, wherein the binder resin has a glass transition temperature of about 50° to about 70° C.

5. The toner of claim 1, wherein the binder resin has a numerical average molecular weight of about 1,000 to about 50,000.

6. The toner of claim 1, wherein the binder resin has a numerical average molecular weight of about 3,000 to about 20,000.

7. The toner of claim 1, wherein the binder resin has a weight average molecular weight to numerical average molecular weight ratio of about 2 to about 60.

8. The toner of claim 1, wherein the emulsion dispersion comprises a colored resin solution in aqueous dispersion.

9. The toner of claim 1, further comprising a charge controlling agent, said charge controlling agent be present in an amount of about 0.1 to about 5 parts-by-weight per 100 parts-by-weight of the binder resin.

10. The toner of claim 9, wherein the amount of charge controlling agent is about 0.1 to about 3 parts-by-weight per 100 parts-by-weight of the binder resin.

11. The toner of claim 1, wherein the organic solvent is a member selected from the group consisting of toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone.

12. The toner of claim 11, wherein the water and organic solvent are removed by heating to a temperature of at least about 100° C.

13. The toner of claim 11, wherein the water and organic solvent are removed by heating to a temperature of at least about 105° C.

14. The toner of claim 1, further comprising a dispersion stabilizer selected from a member of the group consisting of tricalcium phosphate, calcium diphosphate and hydroxycalcium phosphate.

15. The toner of claim 1, wherein the emulsion dispersion further comprises at least one member selected from the group consisting of a magnetic powder and an offset inhibitor.

* * * * *